US006179230B1

(12) United States Patent
Geroux et al.

(10) Patent No.: US 6,179,230 B1
(45) Date of Patent: Jan. 30, 2001

(54) VEHICLE MOUNTED SAND SPREADER

(75) Inventors: Paul Geroux, Ottawa; Larry Cole, Ingersoll; Irwin Plested, London; Achim Martin, Nobel; Larry Magill, Dorchester, all of (CA)

(73) Assignees: Cives Corporation, Roswell, GA (US); Monroe Truck Equipment, Monroe, WI (US)

( * ) Notice: Under 35 U.S.C. 154(b), the term of this patent shall be extended for 0 days.

(21) Appl. No.: 08/866,083

(22) Filed: May 30, 1997

(51) Int. Cl.[7] ..... E01C 19/20
(52) U.S. Cl. ..... 239/672; 414/528
(58) Field of Search ..... 239/672–680, 239/650; 414/502, 527, 528; 296/184

(56) References Cited

U.S. PATENT DOCUMENTS

| | | | | |
|---|---|---|---|---|
| Re. 25,709 | | 1/1965 | Swenson et al. | 275/8 |
| 1,805,489 | | 5/1931 | Kerr et al. . | |
| 2,233,111 | | 2/1941 | Roberts | 214/83 |
| 2,577,310 | | 12/1951 | Connelly | 275/2 |
| 2,697,609 | | 12/1954 | Chase et al. | 275/8 |
| 2,988,368 | | 6/1961 | Kerr | 275/8 |
| 3,048,409 | * | 8/1962 | Elwick | 239/675 X |
| 3,175,829 | | 3/1965 | Ferris | 275/3 |
| 3,179,272 | | 4/1965 | Goldberger | 214/521 |
| 3,229,985 | | 1/1966 | Yuenger et al. | 275/3 |
| 3,300,068 | | 1/1967 | Tarrant, Sr. | 214/83.36 |
| 3,317,066 | | 5/1967 | Hamm | 214/83.36 |
| 3,377,030 | | 4/1968 | Swenson | 239/656 |
| 3,443,763 | | 5/1969 | Wolford | 239/666 |
| 3,474,926 | | 10/1969 | Skromme | 214/519 |
| 3,498,486 | | 3/1970 | Freeman, Jr. | 214/501 |
| 3,550,866 | | 12/1970 | Swenson | 239/677 |
| 3,583,646 | | 6/1971 | Bogenschutz | 239/666 |
| 3,724,187 | | 4/1973 | Bunker | 56/361 |
| 4,056,283 | | 11/1977 | Pow | 298/17.6 |
| 4,082,227 | | 4/1978 | McGrane et al. | 239/675 |
| 4,157,150 | | 6/1979 | Hetrick | 222/626 |
| 4,266,731 | | 5/1981 | Musso, Jr. | 239/676 |

(List continued on next page.)

FOREIGN PATENT DOCUMENTS

| | | | | |
|---|---|---|---|---|
| 649017 | * | 11/1956 | (CA) | 239/673 |
| 2546115 | | 11/1984 | (FR) . | |
| 2658765 | | 8/1991 | (FR) . | |
| 2080662 | * | 2/1982 | (GB) | 239/675 |
| 958573 | | 9/1982 | (SU) . | |
| 1283130 | | 1/1987 | (SU) . | |
| 94/15449 | * | 7/1994 | (WO) | 239/672 |

OTHER PUBLICATIONS

All Purpose Body Swenson, Feb. 13, 1995.
Air–Flo Multi–Purpose Mini–Flo 'N Dump For 2 to 3 Yard Trucks.
Air–Flo 'N Dump Multi–Purpose Truck Body, Jan. 15, 1992.
APB All Purpose Body Swenson Spreader, Oct. 1995.
Radius Dump Spreader, Monroe Snow & Ice Control.
Henderson MUNIBody.
Flo 'N Dump, Multi–Purpose Dump Body, Air–Flo Truck Bodies.
Swenson Spreader, SVFFZ Series.
Frink GI, The Clean Side Combination Dump Spreader.
Anderson Model FM Spreader.

(List continued on next page.)

*Primary Examiner*—Kevin Weldon
(74) *Attorney, Agent, or Firm*—Burns, Doane, Swecker & Mathis, LLP

(57) ABSTRACT

A bin for a sand spreading vehicle is provided with curved lower sidewalls that deliver sand to a central conveyor. The curvature of the sidewalls lowers the center of gravity of the vehicle for a given load; or permits carriage of a greater load for a given height for the center of gravity of the loaded bin.

9 Claims, 2 Drawing Sheets

U.S. PATENT DOCUMENTS

| | | | | |
|---|---|---|---|---|
| 4,767,063 | * | 8/1988 | Wall et al. | 239/672 |
| 4,773,598 | | 9/1988 | Jones | 239/657 |
| 4,886,214 | | 12/1989 | Musso, Jr. et al. | 239/676 |
| 4,925,356 | | 5/1990 | Snead et al. | 414/339 |
| 4,995,773 | | 2/1991 | Lamoureux et al. | 414/489 |
| 5,096,125 | | 3/1992 | Wise et al. | 239/675 |
| 5,286,158 | | 2/1994 | Zimmerman | 414/504 |
| 5,437,499 | | 8/1995 | Musso | 298/26 |
| 5,466,112 | | 11/1995 | Feller | 414/528 |
| 5,772,389 | | 6/1998 | Feller | 414/489 |

OTHER PUBLICATIONS

Torwel Shunk, Reversible Front or Rear Spreader.
Torwel Shunk, Reversible Shunk Spreader.
New Swenson Flat Bottom Hopper Type Spreader, Swenson Spreader.
Torwel, Pioneer in Front & Rear End Spreaders.
Industech Engineering Inc., DBS 81, Dump Body & Spreader.
The "Rockbuster" Custom Steel Body Trailers, Benson Truck Bodies, Inc.
Clement, Fleet Star, May 1, 1993.
Clement, Half Round Rock Trailer, May 1, 1993.
Clement, Frame Trailer Bathtub Body or ½ Round Body, Oct. 1, 1995.
De–Icing Equipment, Tenco Machinery Ltd.

* cited by examiner

VEHICLE MOUNTED SAND SPREADER

FIELD OF THE INVENTION

This invention relates to the field of vehicles used to spread sand and salt on highways. More particularly, it relates to an improved vehicle-mounted box for containing the sand, or salt and sand, to be spread.

BACKGROUND TO THE INVENTION

Typical sand spreading vehicles have a box mounted over the rear portion of the vehicle for containing sand. Centrally located in the bottom of the box is a conveyor for withdrawing sand in controlled portions for distribution on a road surface. This conveyor typically runs the length of the bin from its rear to its front end centrally located and may consist of a chain "ladder" that circulates in a closed loop, dragging sand with the sliding "rungs" forwardly for delivery to an opening for deposit on the roadway.

A further feature of such vehicles is that the sand containing bin may be tipped, in certain configurations, in two directions. The bin may be tipped upwardly at its forward end to dump sand 'en mass' out a rearward, hinged, end panel when excess sand has been loaded and it is desired to empty the vehicle. On occasion such bins may also be tipped sideways about a longitudinal axis aligned with the vehicle's direction of travel. This sideways tipping does not occur to an extensive degree and is not intended for emptying the bin. Rather it is directed to passing sand from the outside bottom corners of the bin to the central conveyor. This tipping action is needed when the bin has a small amount of sand remaining on its bottom, and the sand is no longer sliding spontaneously towards the central conveyor.

To avoid the cost of this sideways tipping mechanism, some spreader vehicles are built with bins having flat, inwardly tapering, "V"-shaped bottom surfaces. In such cases, the sand slides spontaneously to the central conveyor because of the downward slope of the two bottom panels on either side of the conveyor.

A disadvantage of the tapered-bottom bin design is that for a given load of sand, the center of gravity of the loaded vehicle is higher off of the ground than for a flat-bottomed bin. The higher the center of gravity of a vehicle, the greater is the risk that it may tip sideways on uneven terrain. Allowing that such vehicles are built to standards of stability, typically government-enforced, the presence of a tapered bottom reduces the load capacity of such a vehicle.

This invention addresses the objective of maximizing the load capacity of a spreader vehicle without incurring the complications and expense of a side-tipping mechanism.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one feature of the invention, a spreader vehicle with a bin for containing material to be spread and having a floor-mounted conveyor positioned within the bin to extract such material, has bin walls of a specially shaped configuration. Each of the sidewalls is provided with a curved configuration that bends inwardly towards the conveyor, commencing from a height that is above the height of the conveyor. The curvature of this surface terminates at a second, lower height that is, as well, above the height of the conveyor. The bin surface then continues with a relatively flat, terminal region to the edge of the conveyor. This preferably flat terminal region is upwardly angled, proceeding outwardly from the conveyor, at an inclination that is sufficient to cause the material to be spread contained thereon to slide spontaneously to the conveyor, under the agitation arising from vehicular motion.

The advantage of this configuration is that a greater amount of sand may be carried than with flat-tapered bottom bins, while both maintaining the center of gravity of the vehicle below a predefined limit, and ensuring that all of the load in the bin will slide spontaneously towards the central conveyor.

A typical bin width for a vehicle is 88 to 96 inches, with a bin depth of approximately 51 inches to the top of the conveyor. It has been found that in such a vehicle, an incline angle of between 15 to 18 degrees, preferably 16 degrees, is suitable for the inclined terminal regions leading up to a 25 inch conveyor width. The width of this region, measured in the transverse plane of the bin may be in the range 4–6 inches, preferable 4¾ inches. The curved portion of the bin may then have a circular radius of 35 to 40 inches preferably 37 inches, positioned to terminate virtually tangentially with an optional, vertical, upper bin wall portion (typically 14⅜ inches in height), and virtually tangentially with the inclined, terminal flat region.

By combining a curved portion to the bin bottom with an inclined terminal region that ends at the conveyor boundary, the capacity of the bin is maximized while ensuring substantially complete discharge of the load into the conveyor.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
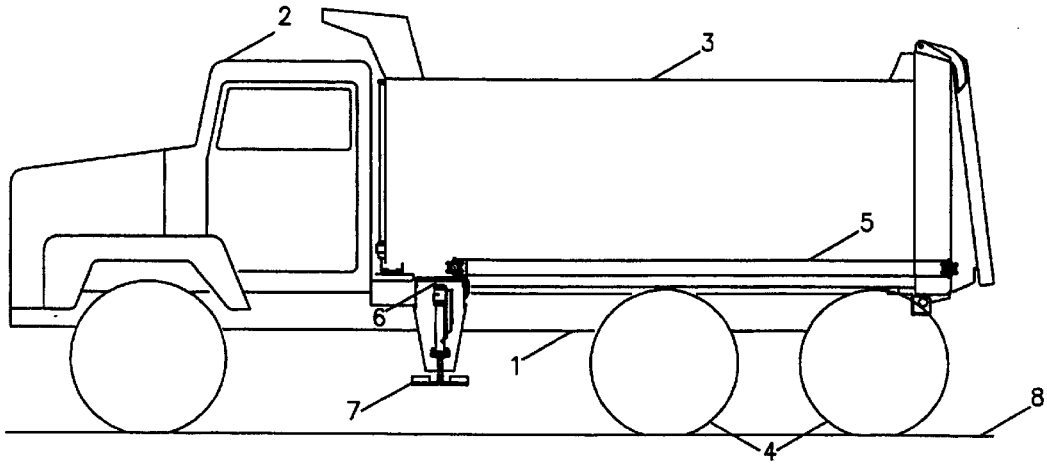
FIG. 1 is a simplified schematic side view of a vehicle carrying a bin in accordance with the invention.

In FIG. 1 a vehicle 1 has a forward operator's cab 2 and a bin 3 mounted over the rear wheels 4 of the vehicle. An underbody, circulating, chain-link conveyor 5 delivers material to be spread, e.g., sand (not shown) to a downwardly exposed opening 6 at the forward end of the bin 3 where sand is to be removed from the bin 3. Further spreading mechanisms 7 thereafter disburse the sand onto the road surface S.

Figure 2:
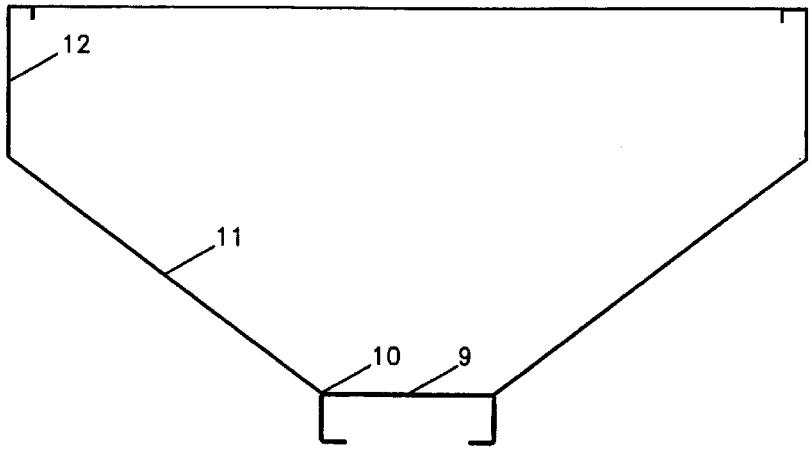
FIG. 2 is a central transverse cross-sectional view through a bin of prior art design having a central conveyor platform and flat tapered bottom panels extending upwardly to vertical bin sides.

In FIG. 2 a prior art bin 10 is shown in transverse cross-section. A central bed 9 serves as a platform 9 for the conveyor 5 (not shown in FIG. 2). The conveyor platform 9 has longitudinal boundaries 10 that meet with flat, angled bottom panels 11. Typically, in prior art bins, these flat, angled bottom panels 11 are inclined upwardly, proceeding away from the conveyor boundaries 10, at angles of on the order of 37 degrees. Such angles have been thought in the past to be necessary to ensure that sand will flow spontaneously to the conveyor platform 9. These panels 11 generally terminate in vertical sidewalls 12.

Figure 3:
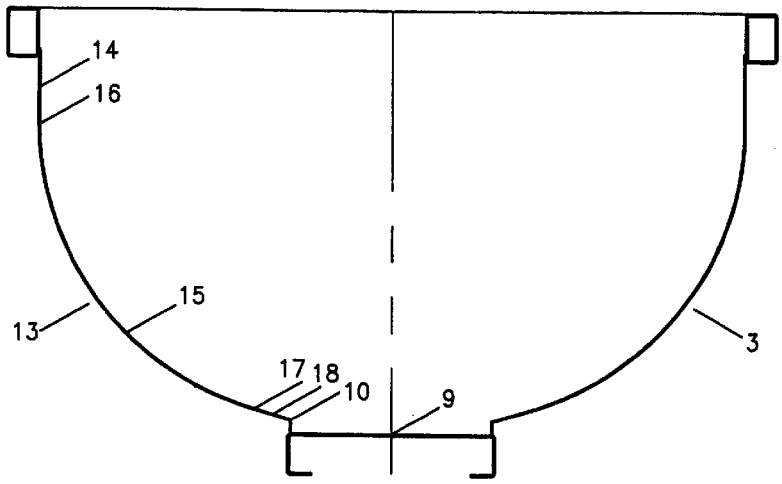
FIG. 3 is a central transverse cross-sectional schematic view through a bin made in accordance with the invention.

In FIG. 3 a bin 3 in accordance with the invention is shown in transverse cross-section with sidewalls 13 shaped in accordance with the invention. Upper vertical portions 14 of the sidewalls are optional: the bin sidewalls 13 may commence with inwardly curved portions 15. These curved portions 15 are preferably circular but need not be precisely circular. It is sufficient for such curved portions to transition from near vertical upper edges 16 to near horizontal lower edges 17. A preferred configuration is circular with a radius of 24 to 48 inches, preferably 35 to 40 inches, more preferably 37 inches.

At its lower edge 17 the sidewall 13 transitions to a relatively straight sidewall-bottom, terminal portion 18 in a near tangential, preferably fully tangential manner. This sidewall bottom terminal portion 18 is upwardly inclined, extending outwardly from the conveyor boundary 10 at an angle of between 7 to 30 degrees, preferably 14 to 17 degrees, more preferably at substantially 16 degrees.

Depending on the width of the conveyor platform 9, this sidewall, bottom, terminal portion 18 may have a width of from zero to 20 inches, preferably 4 to 6 inches, more preferably about 5 inches.

Figure 4:
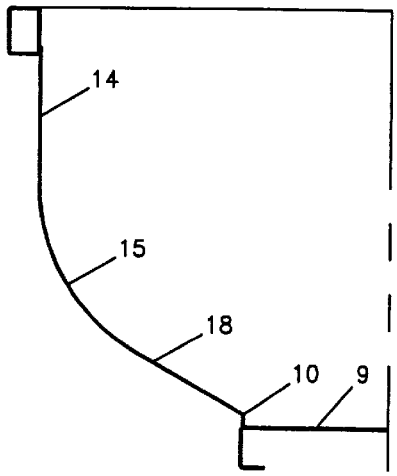
FIGS. 4 and 5 are half, transverse, cross-sectional schematic views through a bin similar to FIG. 3 showing differing profiles for the bin sidewalls that are within the invention.

In FIG. 4 the conveyor or platform 9 width is near its practical maximum, e.g. 36 inches full width, and the terminal portion 18 of the sidewall is 20 inches wide and elevated at 30 degrees. The radius of the curved portion 15 has a 24 inch radius.

Figure 5:
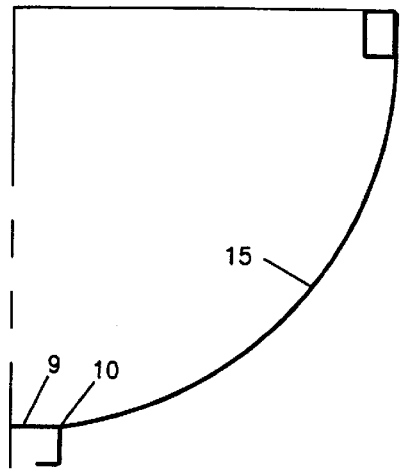

In FIG. 5 the curved portion radius is near maximum, at 48 inches, and terminates directly at the conveyor boundary 10 of a 12 inch wide conveyor platform 9. No terminal flat portion lies between the curved portion 15 and the conveyor platform 9. The curved portion is, however, angled upwardly by 7 degrees from the horizontal at the point where it meets the conveyor boundary 10.

In operation, sand on the bottom, terminal portion 18 of the sidewall 13 has only a modest tendency to slide spontaneously onto the conveyor platform 9. This tendency is, however, enhanced by the agitation of the bin 3 that arises from vehicular motion. When only the bottom, terminal portion 18 of the bin 3 is covered with sand, the bin 3 is virtually unloaded in all events.

Because the bin sidewall 13 rises in a curved path outwardly of the terminal bottom portion 18 of the sidewall 13, sand present on such higher, curved surface has an increasing tendency to slide downwardly, as proceeding outwardly and higher up the bin wall 13. The tendency of higher up sand to slide downward spontaneously causes sand on the terminal bottom portion 18 to be pushed onto the conveyor platform 9. It is thus not necessary to provide a bin 3 with flat, angled bottom panels 11 (as in FIG. 2) that are constantly angled at a steeper inclination across their full extent to ensure the continuous delivery of sand to the conveyor 5.

The result is that a bin made in accordance with the invention will have a lower center of gravity for the same load, or a higher load capacity for the same center of gravity, that prior bins of the "V"-shaped bottom type.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed are as follows:

1. A bin for containing material to be spread by a spreader vehicle having a floor-mounted conveyor positioned within the bin to extract such material, wherein the bin walls are provided with:

(a) a curved portion that bends inwardly towards the conveyor, commencing from a first height that is above the level of the conveyor, and terminating at a second, lower height that is also above the level of the conveyor;

(b) a terminal region extending to the edge of the conveyor, such terminal region being upwardly angled, proceeding outwardly from the conveyor, at an inclination that is sufficient to cause material to be spread when contained thereon to slide spontaneously to the conveyor, under the agitation arising from vehicular motion.

2. A bin as in claim 1 wherein the terminal portion is elevated at an inclined angle of between 7 to 30 degrees.

3. A bin as in claim 2 wherein the terminal portion is elevated at an inclined angle of 14 to 17 degrees.

4. A bin as in claims 1, 2 or 3 wherein the curved portion of the bin has a circular radius of 24 to 48 inches.

5. A bin as in claim 4 wherein the curved portion has a circular radius of 35 to 40 inches.

6. A bin as in claim 5 wherein the curved portion terminates virtually tangentially with a vertical upper bin wall portion.

7. A bin as in claim 1, wherein the curved portion terminates at a relatively flat terminal region having a width of from one to 20 inches.

8. A bin as in claim 1, wherein the curved portion terminates at a relatively flat terminal region having a width of from 4 to 6 inches.

9. In a spreader vehicle having a bin with a conveyor disposed along the bottom portion of the bin, a bin sidewall which is continuously curved from an outer, upper, near vertical portion of the sidewall to a lower, inner, near horizontal portion of the sidewall, the terminal boundary of the inner portion of the curved sidewall being inclined above the horizontal at an angle sufficient to induce sand contained therein to slide downwardly, in the presence of agitation arising from vehicle motion, into the conveyor.

* * * * *

UNITED STATES PATENT AND TRADEMARK OFFICE

CERTIFICATE OF CORRECTION

PATENT NO. : 6,179,230 B1
APPLICATION NO. : 08866083
DATED : January 30, 2001
INVENTOR(S) : Paul Geroux et al.

It is certified that error appears in the above-identified patent and that said Letters Patent is hereby corrected as shown below:

Claim 1, line 12, delete "proceeding" and insert therefor --extending--;
lines 13 and 14, delete "material to be spread when contained thereon" and insert therefor --material to be spread when positioned thereon--;

Claim 2, line 1, delete "portion" and insert therefor --region--;

Claim 3, line 1, delete "portion" and insert therefore --region--';

Claim 7, lines 1 and 2, delete "curved portion terminates at a relatively flat terminal region having" and insert therefor
--terminal regional is relatively flat and has--;

Claim 8, lines 1 and 2, delete "curved portion terminates at a relatively flat terminal region having" and insert therefor
--terminal regional is relatively flat and has--;

Claim 9, line 3, delete "outer";
line 4, delete "inner";
line 6, delete "inner" and insert therefor --lower--; and delete "above" and insert therefor --to--.

Signed and Sealed this

Second Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 6,179,230 B1
APPLICATION NO. : 08/866083
DATED : January 30, 2001
INVENTOR(S) : Paul Geroux et al.

It is certified that error appears in the above-identified patent and that said Letters Patent is hereby corrected as shown below:

Column 4, Claim 7, lines 1 and 2, delete "terminal regional" and insert therefor --terminal region--

Column 4, Claim 8, lines 1 and 2, delete "terminal regional" and insert therefor --terminal region--

Signed and Sealed this

First Day of May, 2007

JON W. DUDAS
*Director of the United States Patent and Trademark Office*